US008622725B2

(12) United States Patent
Tsuboi

(10) Patent No.: US 8,622,725 B2
(45) Date of Patent: Jan. 7, 2014

(54) MECHANICAL COMPRESSION RATIO CHANGING SCREW COMPRESSOR

(75) Inventor: Noboru Tsuboi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 93 days.

(21) Appl. No.: 13/252,464

(22) Filed: Oct. 4, 2011

(65) Prior Publication Data

US 2012/0134866 A1 May 31, 2012

(30) Foreign Application Priority Data

Nov. 26, 2010 (JP) ..... 2010-263343

(51) Int. Cl.
*F03C 2/00* (2006.01)
*F03C 4/00* (2006.01)
*F04C 18/00* (2006.01)

(52) U.S. Cl.
USPC ..... 418/201.2; 418/180; 418/201.1; 418/270; 417/310; 417/440

(58) Field of Classification Search
USPC ..... 418/180, 201.1, 201.2, 205, 270; 417/310, 440
See application file for complete search history.

(56) References Cited

U.S. PATENT DOCUMENTS 5,195,881 A * 3/1993 George, Jr. ..... 418/201.2
5,207,568 A * 5/1993 Szymaszek ..... 418/201.2
6,045,344 A 4/2000 Morisawa et al.
6,082,985 A 7/2000 Matsukuma et al.
6,484,522 B2 11/2002 Tsuboi
6,530,753 B2 * 3/2003 Aramaki ..... 417/310
7,104,772 B2 9/2006 Tsuboi

FOREIGN PATENT DOCUMENTS

JP 56-156994 U 11/1981
JP 9-317676 12/1997
JP 2001-336489 A 12/2001
JP 2003-3976 A 1/2003
JP 2003003976 A * 1/2003 ..... F04C 18/16

OTHER PUBLICATIONS

U.S. Appl. No. 13/252,464, filed Oct. 4, 2011, Tsuboi.
Korean Office Action issued Feb. 21, 2013 in Patent Application No. 10-2011-124020 with English Translation.
Office Action issued Jan. 29, 2013 in Japanese Patent Application No. 2010-263343 (with English-language translation).

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

A screw compressor includes a pair of rotors housed in a rotor chamber. A gas sucked from an intake channel is compressed by the screw rotors and discharged from a discharge channel. A columnar space having a functional end face with an opening into an intermediate pressure section, which is an empty space in the rotor chamber and isolatable from both the intake channel and the discharge channel by the screw rotors. The functional end face has an opening into a bypass channel in communication with the discharge channel. A piston, inserted in the columnar space and brought into contact with the functional end face, separates the intermediate pressure section from the bypass channel when the piston contacts the functional end face. A pressure detection channel allows an area located on an opposite side of the functional end face in the columnar space to communicate with the discharge channel.

11 Claims, 5 Drawing Sheets

MECHANICAL COMPRESSION RATIO CHANGING SCREW COMPRESSOR

BACKGROUND OF THE INVENTION

1. Field of the Invention

This invention relates to a screw compressor.

2. Description of the Related Art

The pressure of an intake channel and the pressure of a discharge channel in a screw compressor are determined by both an air charging unit (an atmospheric pressure in a case of sucking atmospheric air) and demand equipment. On the other hand, the pressure of gas obtained immediately before the gas is discharged from a rotor chamber to the discharge channel in the screw compressor is determined by the pressure of the intake channel and a mechanical compression ratio (a volume ratio) of the screw compressor. When the pressure of gas obtained immediately before the gas is discharged from the rotor chamber is higher than the pressure of the discharge chamber, the gas will be expanded at the moment when the gas is delivered into the discharge chamber, resulting in a drop of the pressure. Therefore, all power used for compressing the gas by an amount corresponding to a difference between the pressures will be wasted.

Some of the screw compressors comprise a slide valve for changing the degree of opening of a discharge port and have a capability of adjusting the mechanical compression ratio as described in Japanese Patent H09-317676-A, for example. However, the slide valve is complex in structure and significantly increases costs. Moreover, the slide valve has a drawback of requiring complex control.

SUMMARY OF THE INVENTION

In view of the problems set forth above, the present invention advantageously provides a screw compressor which is simple in structure and yet capable of changing a mechanical compression ratio.

To overcome at least one or more of the aforementioned problems, the screw compressor according to the present invention, in which a pair of intermeshing male and female screw rotors are housed in a rotor chamber formed in a casing, and a gas sucked from an intake channel is compressed by the screw rotors and discharged from a discharge channel, comprises: a columnar space provided with a functional end face having an opening into an intermediate pressure section, which is an empty space in the rotor chamber and isolatable from both the intake channel and the discharge channel by the screw rotors, and also having an opening into a bypass channel which is communicated with the discharge channel; a piston fittingly inserted in the columnar space and brought into contact with the functional end face, to thereby separate the intermediate pressure section from the bypass channel when the piston is brought into contact with the functional end face; and a pressure detection channel for allowing an area located on an opposite side of the functional end face across the piston in the columnar space to communicate with the discharge channel.

According to the above-described structure, when the pressure of the intermediate pressure section is higher than a discharge pressure, the piston is moved away from the functional end face, thereby allowing the intermediate pressure section to communicate with the bypass channel. As a result, the gas is discharged from the intermediate pressure section into the discharge channel, which means that the mechanical compression ratio of the screw compressor is actually reduced. In this way, the power can be prevented from being wasted on excessive compression. Further, in the structure of this invention, the piston is shifted by means of a difference in pressure between the intermediate pressure section and the discharge channel, to thereby cause the bypass channel to be opened (through connection of the intermediate pressure section to the discharge channel)/closed (through disconnection of the intermediate pressure section from the discharge channel) for changing the mechanical compression ratio. Therefore, the mechanical compression ratio can be changed without the need to provide power and control for driving, and achieved with simple structure.

In addition, the screw compressor of the present invention may further comprise: a low pressure channel for allowing the area located on the opposite side of the functional end face in the columnar space to communicate with the intake channel; a pressure detection channel valve capable of blocking the pressure detection channel; and a low pressure channel valve capable of blocking the low pressure channel.

According to the above-described structure, the piston can be moved away from the functional end face by blocking the pressure detection channel valve while opening the low pressure channel vale, to maintain the mechanical compression ratio of the screw compressor at a low level regardless of the pressure of the discharge channel. When the pressure of the intermediate pressure section is close in value to the pressure of the discharge channel, the bypass channel might be repeatedly opened and closed at frequent intervals. However, the bypass channel can be continued open by means of the pressure detection channel valve and the low pressure channel valve, which can, in turn, prevent the pressure of the discharge channel from being fluctuated in response to the change in compression ratio of the screw compressor caused by movement of the piston.

Still further, in the screw compressor of the present invention, the intermediate pressure section may be a region which can be communicated with the discharge channel depending on a rotational position of the screw rotors.

According to this configuration, because the gas is not recompressed in a working space after the disconnection from the bypass channel in a state where the bypass channel is open, unnecessary compression work is not performed.

DESCRIPTION OF THE PREFERRED EMBODIMENTS

Figure 1:
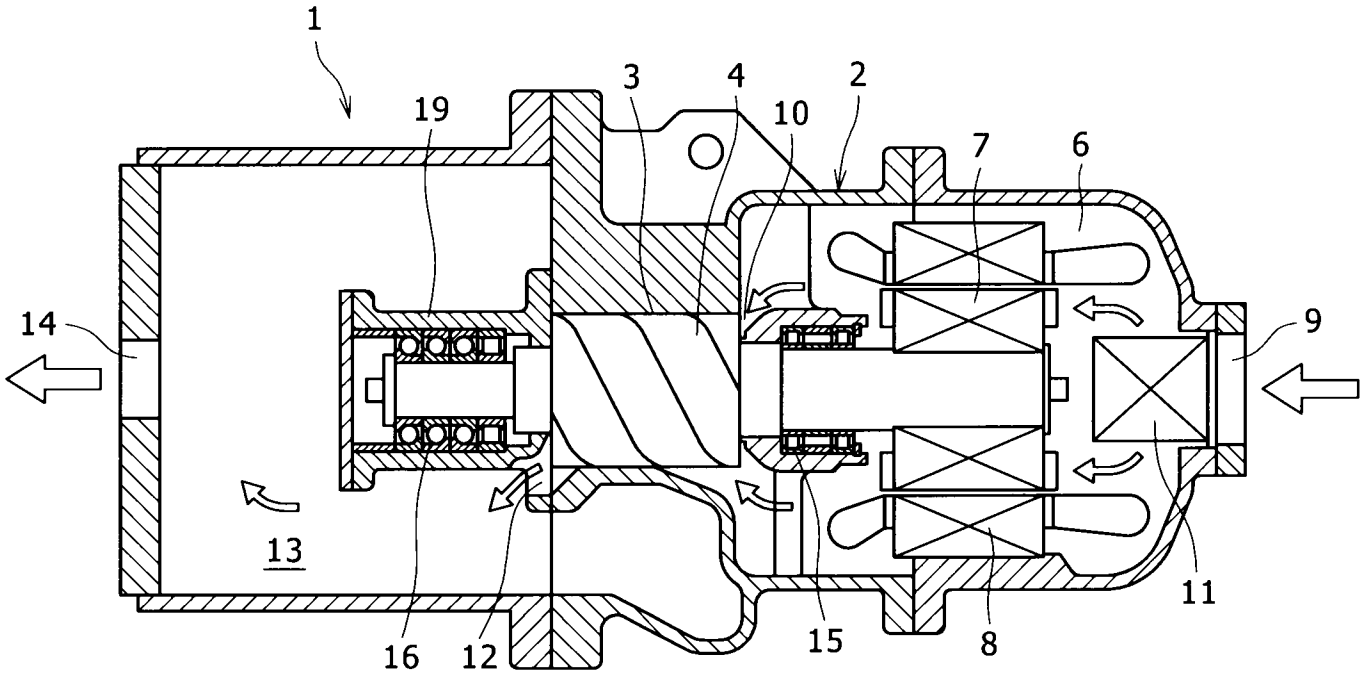
FIG. 1 is a side cross sectional view of a screw compressor according to a first embodiment of the present invention taken along an axial direction.
Figure 2:
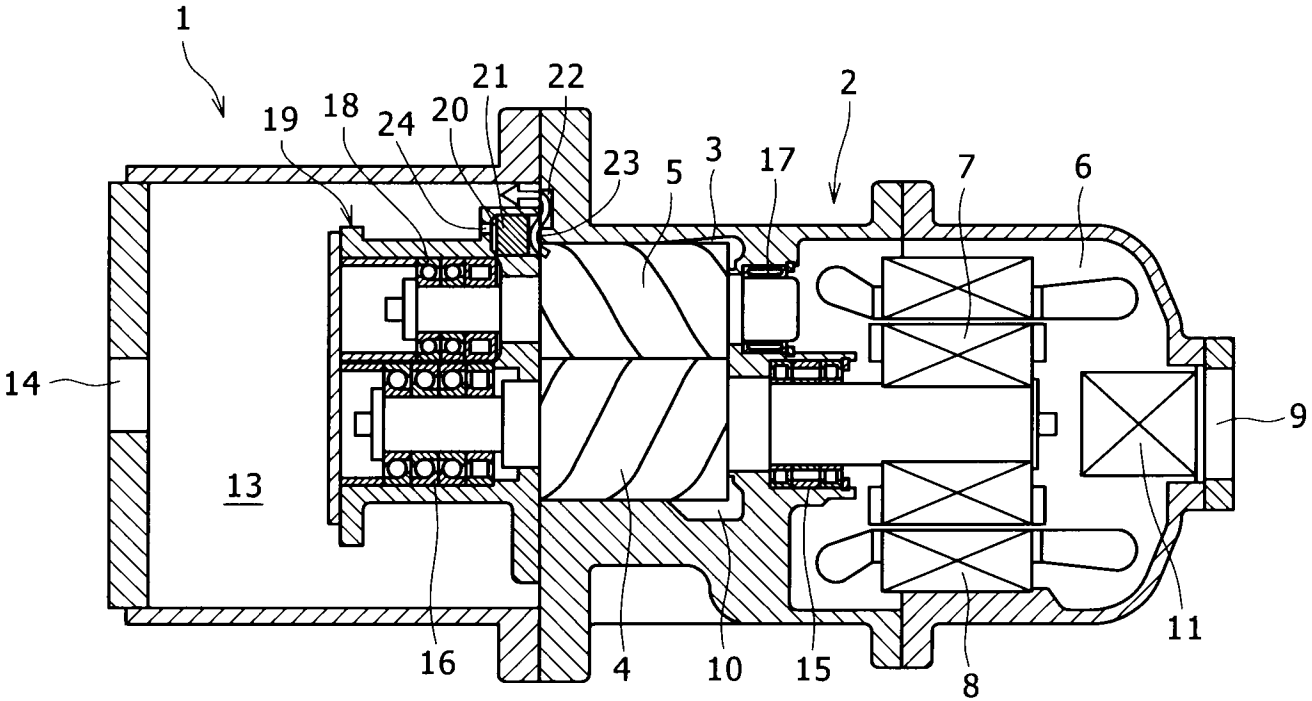
FIG. 2 is a top cross sectional view of the screw compressor in FIG. 1 taken along the axial direction.

Hereinafter, preferred embodiments of the present invention will be described with reference to the drawings. FIGS. 1 and 2 show the structure of a screw compressor 1 according to a first embodiment of this invention. In the screw compressor 1, a rotor chamber 3 formed in a casing 2 houses a male screw rotor 4 and a female screw rotor 5 which are intermeshing with each other, while a motor chamber 6 also formed in the casing 2 houses a rotor 7 and a stator 8 of a motor for driving the male rotor 4.

The screw compressor 1 sucks external air from an intake port 9 formed in an end region of the motor chamber 6 and supplies a gas to the rotor chamber 3 via an intake channel 10 which connects the rotor chamber 3 to the motor chamber 6. A supply air filter 11 is installed inside the intake port 9. The gas supplied to the rotor chamber 3 is compressed in a working space defined by the male screw rotor 4 and the female screw rotor 5 in the rotor chamber 3, discharged through a discharge channel 12 into a discharge space 13, and supplied from a discharge port 14 to a desired system. Shafts of the screw rotors 3 and 4 are supported by bearings 15 to 18, and the bearings 16 and 18 located on a discharge side are retained in a bearing block 19 which seals the rotor chamber 3.

Figure 3:
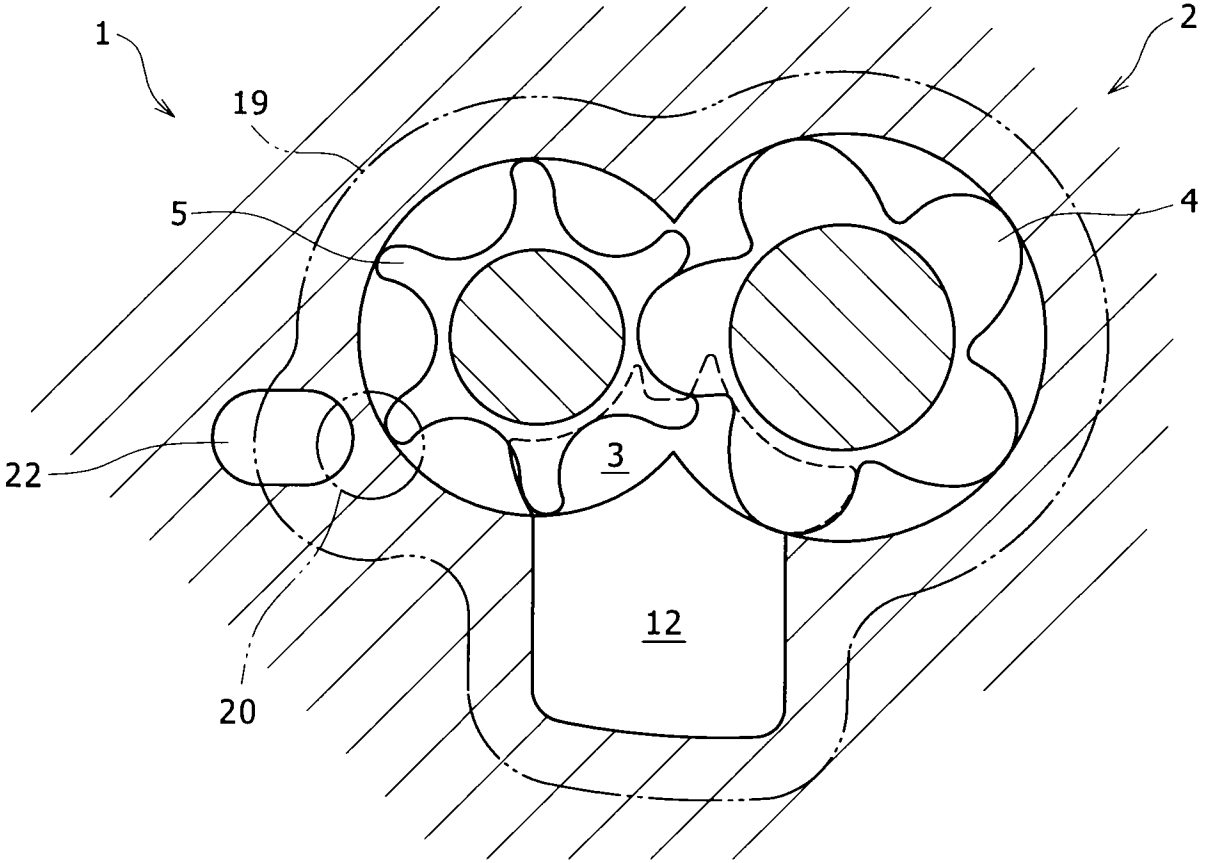
FIG. 3 is a cross sectional view of the screw compressor in FIG. 1 taken along a direction orthogonal to the axial direction.

As shown in FIG. 2, a columnar space 20, which opens into a female screw rotor 5-side-outer edge region at a discharge-side end region of the rotor chamber 3, is formed in the bearing block 19. A piston 21 is fittingly inserted in the columnar space 20. On an end face of the casing 2 closely contacted with the bearing block 19, a slot extended from a location faced with the columnar space 20 in a region outside the rotor chamber 3 to the outside of the bearing block 19 is formed to define a bypass channel 22 through which the columnar space 20 is communicated with the discharge space 13. In addition, the columnar space 20 is also open, as shown in FIG. 3, to an intermediate pressure section which is an empty space in the rotor chamber 3 where the working space formed by the screw rotors 4 and 5 can be isolated from the discharge channel 12.

As shown in FIG. 2, the piston 21 can cause an intermediate pressure section of the rotor chamber to be isolated from the bypass channel 22 by making contact with an end face (a functional end face 23) of the columnar space 20 located on a rotor chamber 3 side and defined by an end face of the casing 2. Moreover, a pressure detection channel 24 communicating with the discharge space 13 and functioning to make the pressure of an internal area on the opposite side of the functional end face 23 in the columnar space 20 equal to the pressure of the discharge space 13 and thus the pressure of the discharge channel 12 is formed on the opposite side of the functional end face 23 in the columnar space 20.

The pressure of the intake channel 10 is equal to that of outside air, while the pressure of the discharge space 13 and the discharge channel 12 is equal to a setting pressure of demand equipment. The pressure of the intermediate pressure section is determined both from a volume ratio (of, for example, Vi=2.0) between a volume of the working space obtained at the moment when the working space is isolated from the intake channel 10 and a volume of the working space obtained at the moment when the working space is opened to the columnar space 20 and from the pressure of the intake channel 10. It should be noted that a pressure in the rotor chamber 3 is known to be computable assuming that the pressure is polytropic change.

When the pressure of the intermediate pressure section in the rotor chamber 3 is lower than that of the discharge space 13, the gas flows into the rotor chamber 3 from the discharge space 13 through the bypass channel 22 and the columnar space 20. At this time, the pressure of an area on a functional end face 23 side of the columnar space 20 becomes slightly lower than that of an area on the other side of the columnar space 20 across the piston 21 due to a pressure loss in both the bypass channel 22 and the columnar space 20. As a result, the piston 21 is shifted toward the rotor chamber 3 and brought into contact with the functional end face 23, to thereby isolate the bypass channel 22 from the rotor chamber 3. The isolation places the screw compressor 1 under a condition the same as that of a conventional screw compressor including neither the columnar space 20 nor the bypass channel 22, and allows the screw compressor 1 to compress the gas at the ratio (of Vi=3.0, for example) between the volume of the working space obtained at the moment when the working space is isolated from the intake channel 10 and the volume of the working space obtained at the moment when the working space is opened to the discharge channel 12.

When the pressure of the intermediate pressure section in the rotor chamber 3 is higher than that of the discharge space 13, a difference between the pressures causes the piston 21 to move away from the functional end face 23. As a result, the gas flows into the discharge space 13 from the intermediate pressure section through the columnar space 20 and the bypass channel 22. In the screw compressor 1, the working space moves according as the screw rotors 4 and 5 rotate. While the working space is opened to the columnar space 20, however, the gas is discharged into the discharge space 13 by an amount corresponding to a decrease in volume of the working space so that compression work is not performed. As shown in FIG. 3, the intermediate pressure section which is in communication with the columnar space 20 can be also communicated with the discharge channel 12 depending on a rotational position of the female rotor 5. This means that once the working space is opened to the columnar space 20, the compression work is not performed even after the working space is isolated from the columnar space 20, which prevents energy from being wastefully consumed. In other words, isolation of the piston 21 from the functional end face 23 has an effect the same as that obtained when the discharge channel 12 is actually enlarged, and reduces the mechanical compression ratio of the screw compressor 1 to Vi=2.0.

Figure 4:
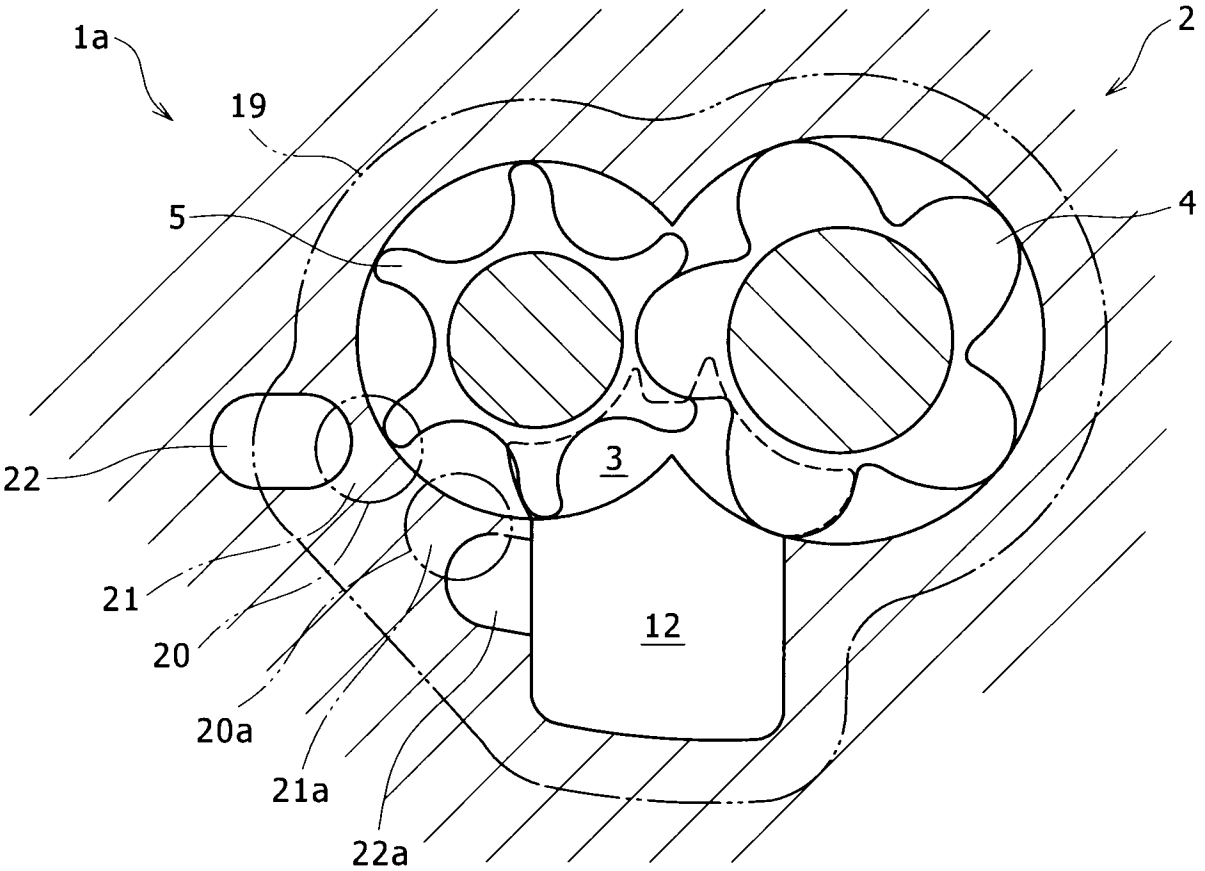
FIG. 4 is a cross sectional view of a screw compressor according to a second embodiment of the present invention taken along the direction orthogonal to the axial direction.

FIG. 4 shows a screw compressor 1*a* according to a second embodiment of the present invention. It should be noted that, in the second embodiment, components identical to those of the first embodiment are designated by the same reference numerals as those of the first embodiment, and descriptions related to these components will not be repeated. The screw compressor 1*a* of the second embodiment is provided, between a first columnar space 20 and the discharge channel 12 which are arranged in a way identical to that of the first embodiment, with a second columnar space 20*a* into which a second piston 21*a* is fittingly inserted. In the casing 2, a slot extended from a location faced with the second columnar space 20*a* and opened to the discharge channel 12 is formed to define a second bypass channel 22*a*. The second columnar space 20*a*, the piston 21*a*, and the bypass channel 22*a* have the same effect as that obtained by the first columnar space 20, the piston 21, and the bypass channel 22, but provide a different volume ratio (of Vi=2.5, for example) when the rotor chamber 3 is connected to the bypass channel 22*a*.

In the second embodiment, because an optimum volume ratio is automatically selected from three volume ratios (of Vi=3.0, 2.5, and 2.0), a power loss resulting from a situation where the screw compressor 1*a* excessively compresses the gas to a pressure higher than a necessary pressure for demand equipment can be effectively reduced.

Figure 5:
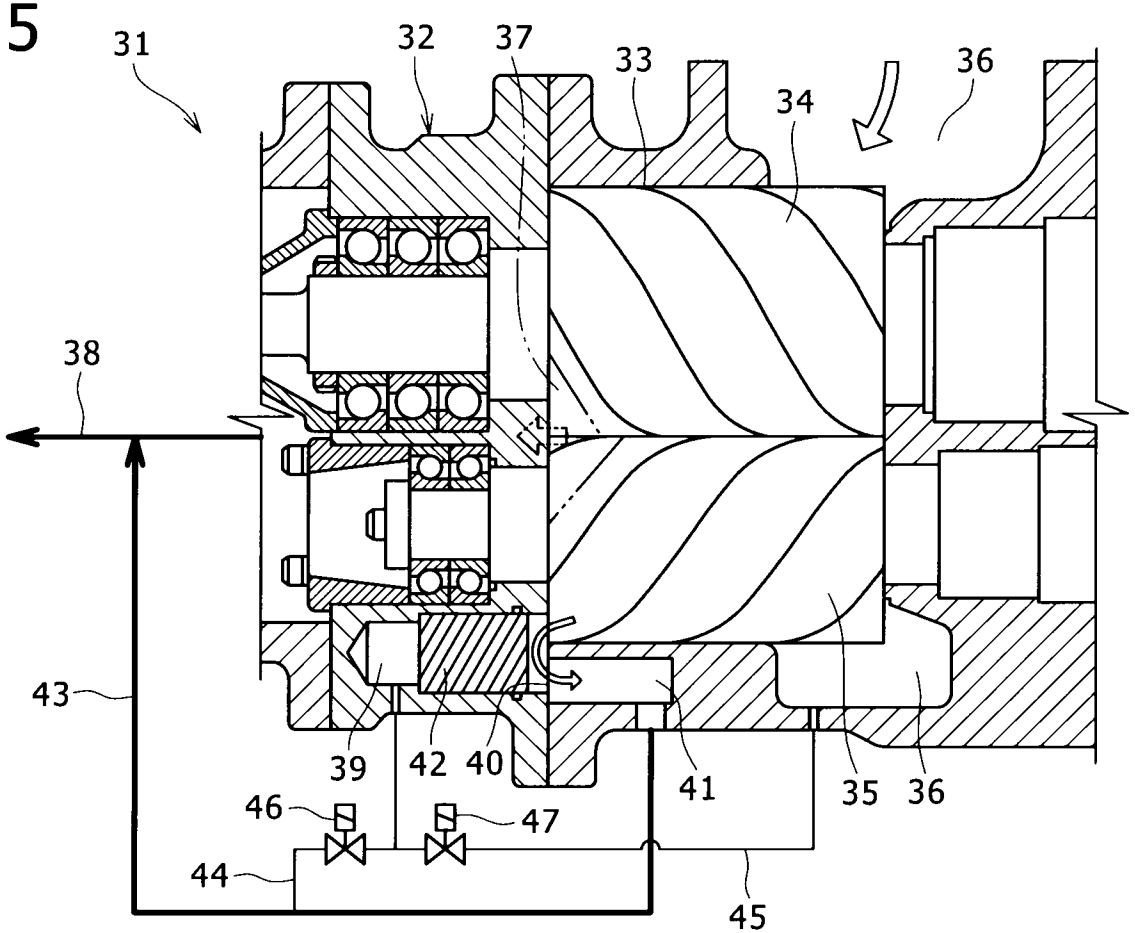
FIG. 5 is a top cross sectional view of a screw compressor according to a third embodiment of the present invention taken along the axial direction.

FIG. 5 shows a screw compressor 31 according to a third embodiment of the present invention. In the screw compressor 31 of the third embodiment, a male screw rotor 34 and a female screw rotor 35 which are intermeshing with each other are housed in a rotor chamber 33 formed in a casing 32, and a gas taken in from an intake channel 36 is discharged into a discharge channel 37. The discharge channel 37 is directly connected to an external discharge pipe arrangement 38.

Further, in the casing 32, a columnar space 39 opening into an end face of the rotor chamber 33 on the discharge side is formed in such a manner that the columnar space 39 is allowed to communicate with the intermediate pressure section which can be isolated from the discharge channel 37 by the screw rotors 34 and 35. Still further, in the columnar space 39, a functional end face 40 having an opening into the intermediate pressure section also has an opening into a bypass channel 41 formed at a position radially outside the rotor chamber 33 in the casing 32, to thereby allow indirect connection between the intermediate pressure section and the bypass channel 41. Because a piston 42 is fittingly inserted in the columnar space 39, the intermediate pressure section can be isolated from the bypass channel 41 when the piston 42 is brought into close contact with the functional end face 40. The bypass channel 41 is in communication with the discharge pipe arrangement 38 and thus the discharge channel 37 via a bypass pipe arrangement 43 externally provided to the casing 32.

Moreover, the screw compressor 31 of this embodiment includes a pressure detection channel 44 that includes an external pipe arrangement for allowing an area located on the opposite side of the functional end face 40 in the columnar space 39 to be communicated with the discharge channel 37 through the discharge pipe arrangement 38 and the bypass pipe arrangement 43, and also includes a low pressure channel 45 that includes an external pipe arrangement for allowing the area located on the opposite side of the functional end face 40 in the columnar space 39 to be communicated with the intake channel 36. The pressure detection channel 44 is equipped with a pressure detection channel valve 46 capable of blocking the pressure detection channel 44, while the low pressure channel 45 is equipped with a low pressure channel valve 47 capable of blocking the low pressure channel 45.

In this embodiment, by closing the pressure detection channel valve 46 while opening the low pressure channel valve 47, the pressure of an area located on a functional end face 40 side in the columnar space 39 is always kept higher than the pressure of an internal area on the other side across the piston 42 in the columnar space 39 regardless of the pressure of the discharge channel 37, and the bypass channel 41 can be thus maintained in communication with the intermediate pressure section of the rotor chamber 33. In this way, when the pressure of the discharge channel 37 fluctuates above and below the pressure of the intermediate pressure section in the rotor chamber 33, the piston 42 can be prevented from being frequently shifted, thereby repeatedly connecting and disconnecting the intermediate pressure section to the bypass channel 41. Thus, the discharge pressure can be accordingly prevented from fluctuating. This operation is preferably performed in such a manner that both an intake pressure and a discharge pressure of the screw compressor 31 are detected, and a ratio between the detected pressures is maintained within a predetermined range through program control.

It should be noted that the screw compressor according to the present invention may be applied to a refrigeration unit in which a compressor, a condenser, an expansion means, an evaporator, and other components are installed in a circulating channel through which a refrigerant flows.

What is claimed is:

1. A screw compressor, in which a pair of intermeshing male and female screw rotors are housed in a rotor chamber formed in a casing, and a gas sucked from an intake channel is compressed by the screw rotors and discharged from a discharge channel, the screw compressor comprising:

a columnar space including a functional end face having an opening into an intermediate pressure section, which is an empty space in the rotor chamber and is isolatable from both the intake channel and the discharge channel by the screw rotors, and an opening into a bypass channel which communicates with the discharge channel;

a piston fittingly inserted in said columnar space such that when said piston is brought into contact with said functional end face, said piston separates said intermediate pressure section from said bypass channel; and a pressure detection channel that allows an area located on an opposite side of said functional end face across said piston in said columnar space to communicate with the discharge channel, wherein, when a pressure of the intermediate pressure section is lower than a pressure of the discharge channel, the piston is brought into contact with the functional end face by a pressure difference between a side of the piston adjacent the functional end face and the opposite side of said functional end face across the piston in the columnar space, thereby isolating the bypass channel from the rotor chamber, and wherein, when the pressure of the intermediate pressure section is higher than the pressure of the discharge channel, the piston moves away from the functional end face by the pressure difference, thereby causing gas to flow into the discharge channel from the intermediate pressure section via the bypass channel.

2. The screw compressor according to claim 1, further comprising:

a low pressure channel that allows the area located on the opposite side of said functional end face in said columnar space to communicate with the intake channel;

a pressure detection channel valve that blocks said pressure detection channel in a first position and unblocks said pressure detection channel in a second position; and a low pressure channel valve that blocks said low pressure channel in a first position and unblocks said low pressure channel in a second position.

3. The screw compressor according to claim 1, wherein said intermediate pressure section is a region which communicates with the discharge channel depending on a rotational position of the screw rotors.

4. The screw compressor according to claim 1, wherein the columnar space opens into the intermediate pressure section adjacent the female screw rotor.

5. The screw compressor according to claim 1, further comprising a bearing block disposed at a longitudinal end of the screw rotors, the bearing block sealing the rotor chamber and housing bearings that support the screw rotors, wherein the columnar space is disposed in the bearing block adjacent the longitudinal end of the screw rotors.

6. The screw compressor according to claim 5, wherein the discharge channel extends through the bearing block.

7. A screw compressor, comprising:

a male screw rotor;

a female screw rotor that intermeshes with the male screw rotor;

a casing including a rotor chamber in which the male and female screw rotors are housed;

an intake channel via which gas is sucked into the rotor chamber to be compressed by the screw rotors;

a discharge channel via which compressed gas is discharged from the screw rotors into a discharge space;

a columnar space including a functional end face having an opening into an intermediate pressure section, which is an empty space in the rotor chamber and is isolatable from both the intake channel and the discharge channel by the screw rotors, and an opening into a bypass channel which communicates with the discharge space;

a piston fittingly inserted in the columnar space such that when the piston contacts the functional end face, the piston separates the intermediate pressure section from the bypass channel; and a pressure detection channel that allows an area located on an opposite side of said functional end face across said piston in said columnar space to communicate with the discharge space.

8. The screw compressor according to claim 7, wherein the columnar space opens into the intermediate pressure section adjacent the female screw rotor.

9. The screw compressor according to claim 7, further comprising a bearing block disposed at a longitudinal end of the screw rotors, the bearing block sealing the rotor chamber and housing bearings that support the screw rotors, wherein the columnar space is disposed in the bearing block adjacent the longitudinal end of the screw rotors.

10. The screw compressor according to claim 9, wherein the discharge channel extends through the bearing block.

11. The screw compressor according to claim 9, wherein the bypass channel is a recess within an end of the casing that abuts the bearing block.

* * * * *